US006616544B2

(12) United States Patent
Kimmorley

(10) Patent No.: US 6,616,544 B2
(45) **Date of Patent: *Sep. 9, 2003**

(54) CORRECT STANCE INDICATION DEVICE

(76) Inventor: Kenneth Robert Kimmorley, 26A Bungan Head Road, Newport NSW 2106 (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/646,844

(22) PCT Filed: Mar. 26, 1999

(86) PCT No.: PCT/AU99/00223

§ 371 (c)(1),
(2), (4) Date: Sep. 22, 2000

(87) PCT Pub. No.: WO99/49943

PCT Pub. Date: Oct. 7, 1999

(65) Prior Publication Data

US 2002/0173369 A1 Nov. 21, 2002

(30) Foreign Application Priority Data

Mar. 27, 1998 (AU) ..... PP2632
Jun. 18, 1998 (AU) ..... PP4899

(51) Int. Cl.[7] ..... A63B 69/36; A43B 13/38
(52) U.S. Cl. ..... 473/218; 36/144; 36/91
(58) Field of Search ..... 473/218, 217, 473/219, 223, 270, 266, 269, 271; 36/91, 127, 94, 43, 44, 144, 159

(56) References Cited

U.S. PATENT DOCUMENTS 3,774,572 A 11/1973 Borracio
3,922,801 A * 12/1975 Zente
4,020,570 A * 5/1977 Shames
4,033,054 A * 7/1977 Fukuoka
4,079,526 A * 3/1978 Fukuoka
4,115,934 A * 9/1978 Hall
4,288,929 A * 9/1981 Norton et al. ..... 36/69
4,408,402 A * 10/1983 Looney
4,541,186 A * 9/1985 Mulvihill
4,685,227 A * 8/1987 Simmons ..... 36/127
4,712,317 A * 12/1987 Sowell ..... 36/132
4,760,655 A * 8/1988 Mauch
4,819,940 A * 4/1989 Davis ..... 36/127
4,866,861 A * 9/1989 Noone ..... 36/127
4,875,683 A * 10/1989 Wellman et al. ..... 36/127
5,212,894 A 5/1993 Paparo
5,439,226 A 8/1995 Luedtke
5,487,546 A 1/1996 Yasuda
5,564,989 A 10/1996 Larsen
5,572,808 A * 11/1996 Birke
5,864,969 A * 2/1999 Mauch
6,082,024 A * 7/2000 Del Biondi
6,082,027 A * 7/2000 Wagonhurst
6,138,384 A * 10/2000 Messmer

* cited by examiner

*Primary Examiner*—Paul T. Sewell
*Assistant Examiner*—Nini F. Legesse
(74) *Attorney, Agent, or Firm*—Davis & Bujold, P.L.L.C.

(57) ABSTRACT

An indication device for instructing a predetermined golf swing action, or for instructing a predetermined stance during skiing, includes inserts (1, 6, 10, 22) which are adapted and which can be located in use to provide a tactile indication to the user that a predetermined stance has been maintained or deviated from. In the case of golf, the device is particularly adapted such that when not swinging, no such tactile indication to the golfer is provided.

16 Claims, 3 Drawing Sheets

CORRECT STANCE INDICATION DEVICE

FIELD OF THE INVENTION

The present invention relates to an indication device that finds particular application in various sports and hobbies. For example, the mechanism in a preferred form is adapted for interacting with one or both feet of a golfer during a golf swing to provide a tactile indication to the golfer that either or both feet are maintaining recommended positions. The mechanism in another form can be used by a snow-skier in a ski-boot to ensure that body weight is forward in the boot. The invention will be described primarily with reference to its use in golf and snowskiing, but it should be appreciated that the invention may also find applications in other sports where correct stances are required and/or where predetermined weight transfer is necessary (e.g., during a tennis serve, during a hockey swing, during a baseball swing, etc).

BACKGROUND ART

It is known in the game of golf that the correct transfer of body weight between the front and back feet during a golf swing is important in generating power and accuracy, and hence the distance travelled of the struck golf ball resulting from the golf swing.

Golf requires a correct grip of the golf club, the correct posture at the commencement of the swing, and the correct alignment of the body relative to the target line.

It is generally agreed that another important aspect of a successful golf swing is the manner in which weight is transferred between the front and back feet during the back swing, forward swing and follow through of the swing.

Devices, apparatus and systems are known which generally constrain or orient one or both feet of a golfer in predetermined orientations during the swing. However, these devices are often uncomfortable, cumbersome, non-portable, expensive, and/or unnatural to use. Also, many of the existing methods, devices and apparatus are corrective devices rather than being instructional.

U.S. Pat. No. 5,439,226 shows a training apparatus for a golfer which assists the golfer to hold the golfer's head steady during the swing. Two thin flexible rods project outwardly from a stand and are positionable against opposing sides of the golfer's head. GB 2,305,130 discloses a golfer's wrist pronation indicator, being a watch-like device which is fitted to a golfer's wrist and monitors undesirable movements of the wrist during the playing of a golf shot.

U.S. Pat. No. 5,564,989 discloses a sport's training device particularly intended for use by golfers. The device comprises a pair of shoe inserts which are inserted into the heel area of the golfer's shoe. The upper surface of each insert has a tactile indicating member positioned in the heel area and disposed towards the inner edge of the insert. A major problem with this type of insert is that it provides a permanent tactile indication, and thus the golfer's feet become desensitized to the device, often after a very short period of time. Thus, the device fails to provide the necessary tactile indication to instruct the golfer that the swing has deviated from accepted norms.

In the sport of snowskiing, it is widely accepted that for optimum performance and control of the skis, a human user's centre of gravity should be centred over the skis. Modern snowskis include bindings that are positioned in the back half of each ski (i.e., offset rearwardly from the centre of gravity of each ski). A user's ski boots are then fastened in those bindings.

In use, the user's centre of gravity only becomes centered over his/her skis when they lean forward in their boots (i.e., so that each shin presses against the inside front portion (tongue) of the ski-boots). This forward leaning is in part required due to the offset of the bindings and is further facilitated by the user bending his/her legs at the knees and at the ankles.

Optimum ski performance during either traversing or when skiing forwardly down a slope is further enhanced by ensuring that the skier's body weight is directly over the inside edge of the most downhill ski.

Optimum positioning during skiing ensures proper "edging" of the skis and greater precision and performance in general. By way of contrast, when users lean back in their boots, they become less controlled, travel at more erratic speeds and become more prone to accidents.

SUMMARY OF THE INVENTION

In a first aspect, the present invention provides an indication device for instructing a predetermined golf swing action, the device being adapted and located for interacting with the feet of a golfer such that during the golf swing it provides a tactile indication to the golfer's feet to assist in maintaining the predetermined golf swing action, but such that when not swinging it provides no such tactile indication to the golfer's feet.

Such device is to be contrasted with the tactile indicating member 40 of U.S. Pat. No. 5,564,989 which provides a tactile sensation to the golfer during all actions, including actions other than swinging, such as walking. Thus, the user's feet quickly become desensitized to the member 40 and the device becomes ineffectual.

The tactile indication provided during the swing in accordance with the present invention may either be provided when the user's feet assume a correct stance and/or assume an incorrect stance. However, it is most preferred that a tactile indication is provided to a user when a correct stance is assumed to psychologically reinforce this stance to the user.

When the terminology "predetermined golf swing" is used in the present specification, for a right-handed golfer (left-handed being the opposite), it typically refers to a configuration wherein during the back swing at least the right foot/shoe of the golfer remains substantially flat with respect to the ground; and/or a configuration wherein during the swing follow through the right toes of the golfer point generally towards the ground, and/or the outside portion of the left foot has rolled over laterally and outwardly.

Of course, where the device is used for other sports/activities then the predetermined stance would be different according to the sport/activity.

Preferably the device includes one or more inserts adapted for placement in specific locations in relation to the user's feet. Thus, the inserts can be provided in:

the or each shoe of a user; and/or in the or each sock of a user.

The inserts can be one or more parts of a hook and loop fastening system (such as manufactured under the trade mark Velcro®).

Alternatively the inserts can be formed from a deformable polymeric material. In either case, the inserts need to be capable of being sensed tactilely by the or each foot of the user during the swing.

Typically the inserts are located and adapted to provide a psychologically positive tactile indication to the user that the feet have generally maintained a predetermined stance during swinging. The expression "psychologically positive tactile indication" hereinafter refers to the mental acknowledgment induced in the user that the feet have generally maintained the predetermined stance. Thus the inserts are located and/or adapted to be generally passive when not in use (e.g., when the user is not swinging).

In an ideal golf swing, the only points of pressure that a user should experience are those in the user's feet. The applicant has through rigorous experimentation identified four points of pressure in a golfer's feet during correct weight transfer. Two of these points are realized during the back swing and forward swing through to the point of ball impact, and two of these are realized during the swing follow-through.

Preferably for a right-handed golfer (whereas the opposite applies for a left-handed user), on the right foot:

(a) an insert is positioned to be located under the right foot in the arch and immediately in front of the heal pad of the foot; and/or (b) an insert is positioned to be located at the lateral side of the right big toe to extend to and also be located in front of the tip of the big toe; and on the left foot:

(c) an insert is positioned to be located under the left foot in the arch and immediately behind the ball of the foot; and/or (d) an insert is positioned to be located laterally at the outside of the left foot and adjacent to the heel.

The applicant has discovered that the positioning of the inserts at locations (a) and (c) are optimal for sensing the two pressure points that are realized during the back swing and forward swing until ball impact. The applicant has discovered that the positioning of the inserts at locations (b) and (d) are optimal for sensing the pressure points that are realised during the swing follow through.

The inserts used at (a) and (c) are typically relatively more abrasive (sharp) than the inserts used at (b) and (d) (which are typically less abrasive (soft) pads). In this regard, the abrasiveness can be applied by employing an insert formed from the hook or loop portion of a Velcro® fastening system, whereas the soft pad can be formed from a foamed polymeric material (e.g., polyurethane or a covered portion of a Velcro® system). However, multiple combinations of sharp and soft materials are possible (as described hereafter).

Typically, the inserts at (a) and (c) provide a positive indication that the correct swing stance has been maintained during the back swing and forward swing up to ball impact (i.e., where a user should be effectively "pressing down" with the base of the feet (as has been described in the art, at the "inside edges" of the feet and not rolling over). The pressing down "activates" inserts (a) and (c) to provide an appropriate tactile sensation to the user.

Thus, the inserts in (a) and (c) are located and/or adapted such that they are only activated during the pressing down which occurs during the golf swing, but are otherwise typically passive.

Typically, the inserts at (b) and (d) provide a positive indication that the correct swing stance has been achieved in the swing follow-through (i.e., where a user has transferred the majority of body weight from the right to the left foot, so that the left foot rolls over outwards (slightly) and the right foot heel lifts so that the toes point downwardly (primarily pressing down at the big toe).

Alternatively, the inserts can be located and adapted to provide a psychologically negative tactile indication to the user that the feet have generally deviated from the predetermined stance during the golf swing. The expression "psychologically negative tactile indication" hereinafter refers to the mental acknowledgment in the user that the feet have generally deviated or moved from the predetermined stance. Again, the inserts are located and/or adapted to be passive when not in use.

In this alternative arrangement, and preferably for a right-handed golfer (whereas the opposite applies for a left-handed user):

(i) one or more inserts can be positioned adjacent to the outer side of the user's right foot for engagement by the outside portion of the right foot during the back swing; and/or (ii) one or more inserts can be positioned under the user's left foot to be adjacent to the arch thereof for engagement by the arch of the user's left foot during the swing follow through.

Insert (i) indicates that the user has rolled over the right foot (laterally outwards) during the backswing (which is undesirable) and can also indicate that the user's weight is still on the right foot during the forward swing and follow through (i.e., that the user has failed to transfer weight—which is undesirable).

Insert (ii) indicates that the user is still pressing down on the left foot during the swing follow through (i.e., the user is remaining flat footed and is not allowing the left foot to roll laterally outwards at follow through—again which is undesirable).

In a second aspect the present invention provides an indication device for instructing a predetermined stance during skiing, the device being adapted and located for interacting with the feet/legs of a skier such that in use it provides a tactile indication to the skier's feet/legs that indicates that the predetermined stance has been maintained or deviated from.

When the terminology "predetermined stance" is employed in the present specification in relation to snow-skiing, it refers to the configuration wherein one and preferably both shins are urged towards the front (typically defined by the tongue) of a respective ski-boot in use.

Preferably the device of the second aspect employs inserts having a configuration similar to those inserts as per the first aspect of the invention, although for skiing the insert location with reference to a user's feet or legs is typically different.

Typically the inserts are located to provide a psychologically positive tactile indication to a skier, and are located and/or adapted to be generally passive when not in use.

Preferably, for skiing:

(1) an insert is positioned to be located under each foot in the arch and immediately behind the ball of each foot; and/or (2) an insert is positioned to be located in front the user's shins on each leg.

The inserts (1) and (2) are typically abrasive (sharp) and in this regard the abrasiveness can be applied by employing an insert formed from the hook loop portion of a Velcro® fastening system, or from an insert having integrally formed protrusions such as nodules, etc.

In this preferred insert arrangement for skiing, the inserts at (1) are positioned to correspond with a pressure point that occurs in the foot when the user leans forward in a ski boot (the desired position). Similarly, for position (2) the user's shin is pressed forward in the boot so that insert is sensed by the user at the shin.

In some arrangements, inserts may even be positioned behind each heel of a skier, which are again engaged by the user's heel when the user leans forward.

Inserts may also be located and adapted to provide a psychologically negative tactile indication to a skier, indicating that the feet/legs have generally deviated from the predetermined stance during skiing (i.e., when the user leans back in the boots).

In this latter arrangement, the inserts are typically positioned:

(i) behind each user's lower calf muscle for engagement by a user when leaning back; and/or (ii) above the user's toes or front feet portions for engagement therewith when the user's foot moves generally upwardly in the boot when the user is leaning backwards.

The positioning of the inserts in this latter arrangement rapidly indicates to the user that there has been a deviation from the predetermined stance.

Various combinations of sharp and soft inserts can be employed in socks and shoes/boots to achieve differing effects for different user requirements, different feet shape, desired comfort levels etc. Preferably the inserts are incorporated into the user's socks for ease of use, versatility, etc.

The inserts are each typically a flat article (e.g., in the form of a strip). When the insert is a hook and loop fastening system (i.e,. a Velcro® system), preferably either the hook or loop half is used on its own to provide the relatively more abrasive (sharp) sensation. If either individual half gives rise to sensitivities, then it can be covered in use by the opposite half to provide a softer, less harsh indication.

In a further alternative, a flat article having a plurality of integrally formed protrusions that face and extend into the body part in use can be employed. The density of this article can be selected such that the protrusions are sensed tactilely by the user only when a predetermined force is exerted thereon.

Insert polymeric material can include foamed or unfoamed: polyurethane, polyester and poly(aminoether), polyethylene, polypropylene, polyamide, polyvinylchloride, polyacrylamide, vinyl acetate copolymer, polyolefins, poly acrylobutadinestyrene etc.

BRIEF DESCRIPTION OF THE DRAWINGS

Notwithstanding any other forms which may fall within the scope of the present invention, preferred forms of the invention will now be described, by way of example only, with reference to the accompanying drawings in which.

MODES FOR CARRYING OUT THE INVENTION

Figure 1:
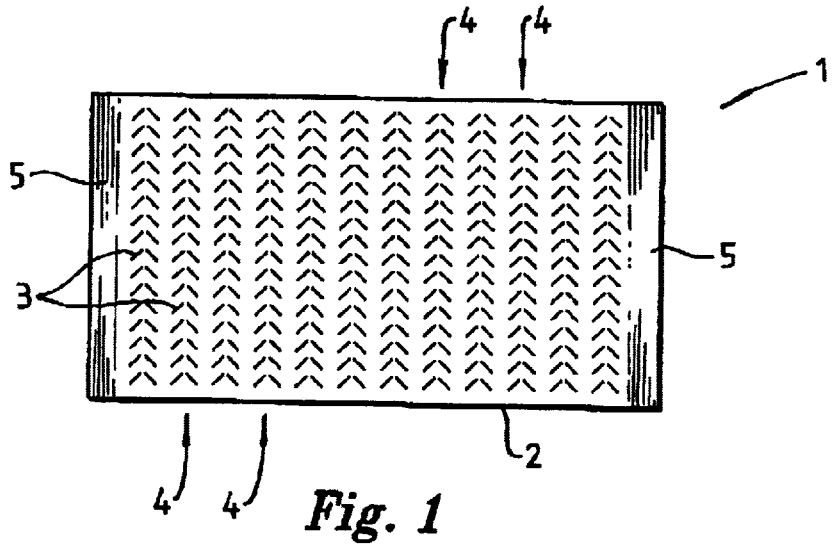
FIG. 1 shows a plan view of one type of preferred insert according to the invention.
Figure 2:
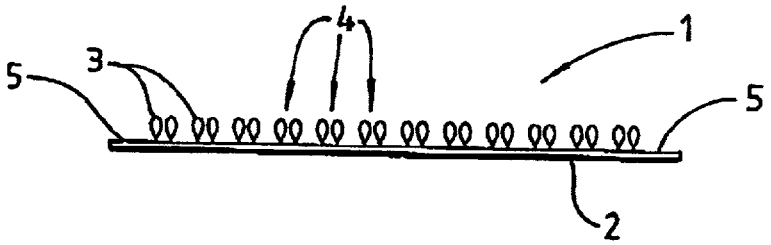
FIG. 2 shows a side view of the insert of FIG. 1.

Referring to FIGS. 1 and 2, an insert in the form of a generally flat Velcro® pad half 1 includes a base 2 having a plurality of loops 3 formed thereon in a number of rows 4. Each loop has a rounded end and is selected to be sufficiently resilient (stiff) to be sensed by a user in use (as explained hereafter). Free end regions 5 enable the pad to be attached to a shoe, sock, insole etc through stitching, adhesion or other suitable means.

The pad 1 of FIGS. 1 and 2 finds particular application in a wide variety of sports, but especially golf and snowskiing, and is most suitable for use in the shoe or boot of the user, but is most preferably incorporated into socks of a user. The employment of loops (as opposed to the hooks of a Velcro® system, or a soft deformable pad) is found to be beneficial when the body region to be contacted is the foot or lower leg, because the loops provide an adequate tactile indication to the user without becoming uncomfortable. This is especially so with the foot, which can be sensitive in some regions and less sensitive in other regions.

Figure 3:
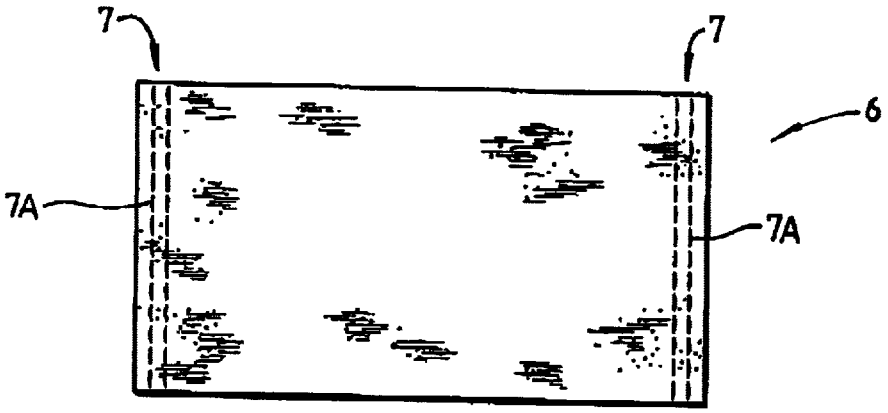
FIG. 3 shows a plan view of an alternative preferred insert according to the present invention.
Figure 4:
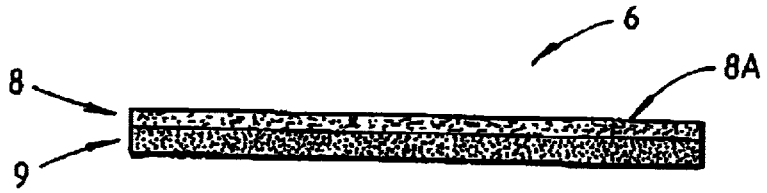
FIG. 4 shows a side view of the insert of FIG. 3.

Referring to FIGS. 3 and 4, a type of soft polymeric pad 6 is shown. This pad includes end regions 7 and upper and lower halves 8, 9. Pad 6 is more likely to be employed to engage against body parts which do not require a loop stimulation (e.g., in very sensitive foot regions). The pad 6 can also be textured in various ways as appropriate to aid tactile stimulation.

End regions 7 can be attached (e.g., stitched 7A, adhered, etc.) to support surfaces 31 in the form of socks, shoes, boots etc. Further, upper half 8 can be formed of a material having e.g., a different density, porosity or other characteristics to lower half 9, which may be e.g., relatively more flexible than upper half 8, etc. Thus differing tactile, breathing, absorbent and other affects can be achieved with the pad by varying these regions. Upper half 8 may also carry a lining 8A formed from a natural material e.g., woven cotton or linen cloth, for satisfactory skin contact.

Typically the pad 6 is formed from a foamed polymeric material, such as polyurethane, polyester, poly(amino ether), polyethylene etc. Other polymers that may be used for pad 6 include polyethylene, polypropylene, polyester, polyamide, polyvinylchloride, polyacrylamide, vinyl acetate copolymer, polyolefins, poly acrylobutadinestyrene etc.

The pad 6 can be injection molded or foam molded. Alternatively, the pads 1 and 6 can be joined (e.g., molded together) to form a composite pad for use in various related or different sporting applications and hobbies. In the composite pad, the foam pad 6 may also be subsequently attached to pad 1 after being injection or foam molded itself.

Figure 5:
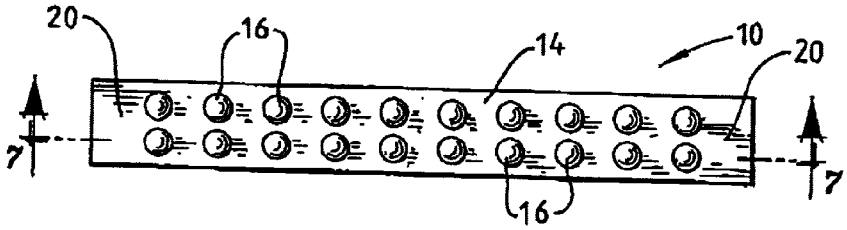
FIG. 5 shows a plan view of another type of insert according to the invention.
Figure 7:
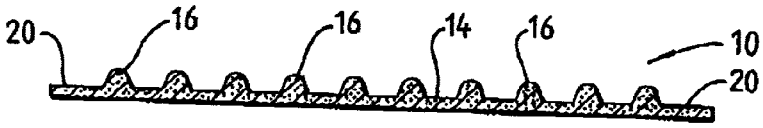
FIG. 7 shows a sectional side elevation taken through the insert of FIG. 5 along the line 7—7.

Referring now to FIGS. 5 and 7 an insert in the form of a generally flat pad 10 includes a base 14 having a plurality of nodules 16 formed thereon (and typically integral therewith). Each nodule has a rounded end which is adapted to be sensed by a user's body part in use. Free end regions 20 enable the pad to be attached to a shoe, sock, glove insole etc through stitching, adhesion or other suitable means.

The pad 10 of FIGS. 5 and 7 finds particular application in snowskiing, and is most suitable for use in the boot of the user. The employment of nodules is found to be beneficial when the body region to be contacted is an insensitive part of the foot or lower leg, because the nodules provide a stimulating tactile indication to the user. This is also the case with certain parts of the foot, which can be relatively less sensitive than other parts of the body.

Figure 6:
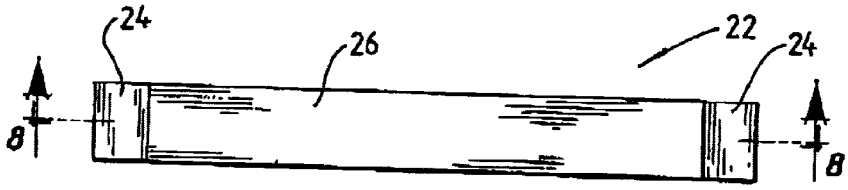
FIG. 6 shows a plan view of a further type of insert according to the invention.
Figure 8:
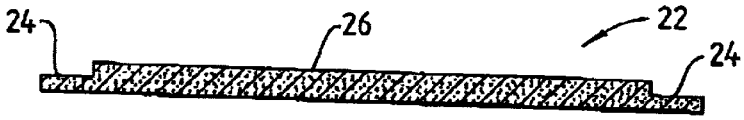
FIG. 8 shows a sectional side elevation taken through the insert of FIG. 6 along the line 8—8.

Referring to FIGS. 6 and 8, a pad 22 similar to pad 6 is shown. This pad includes flat end regions 24 and raised elongated strip 26. Again, pad 22 can be employed to engage against body parts which do not require a nodule-type or Velcro®-type stimulation. Again, the raised region 26 can be scalloped, for example, to engage a curved surface (e.g., a foot arch) or may be textured in other ways as appropriate.

The pad 22 can also be formed from a foamed polymeric material. Typically the pad 10 is formed from an unfoamed polymeric material which is relatively resilient. Suitable polymers for pad 10 include polyethylene, polypropylene, polyester, polyamide, polyvinyichioride, polyacrylamide, vinyl acetate copolymer, polyolefins, poly acrylobutadinestyrene etc.

Figure 12:
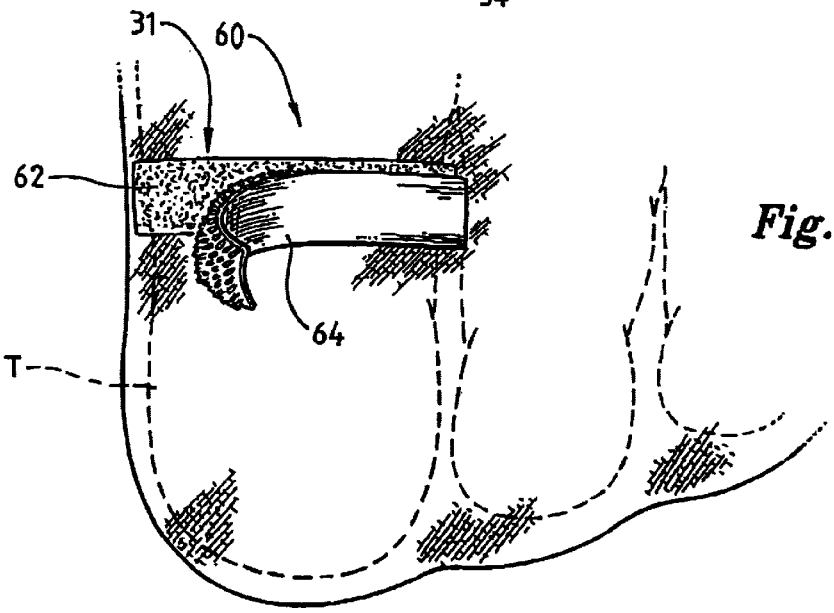
FIG. 12 shows an enlarged schematic representation of an alternative insert when positioned under a user's toe arch.

The pad 10 can be injection molded, whereas the pad 22 can be foam molded. Again, the pads 10 and 22 can be joined (e.g., molded together) to form a composite pad for use in other applications. In the composite pad, the foam pad 22 may also be subsequently attached to pad 10 after being injection or foam molded itself. A further alternative pad is described below (FIG. 12).

A description of FIGS. 9 and 10 will now be made but with reference to the game of golf and to a right-handed golfer. It should be appreciated that the situation is analogous but opposite for a left-handed golfer (and different arrangements would be required in other sports).

Figure 9:
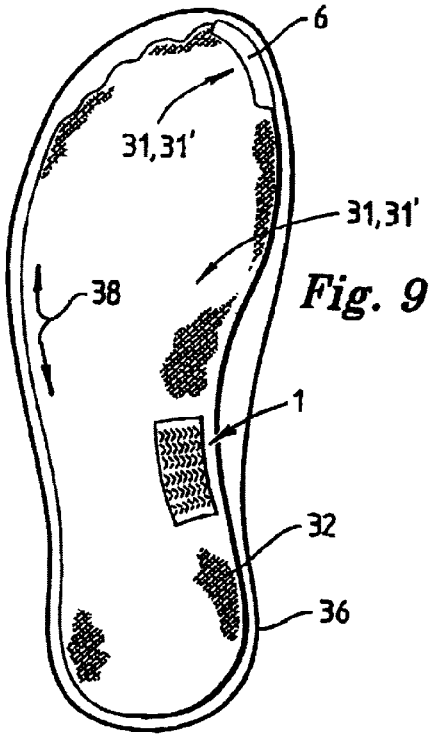
FIG. 9 shows a schematic underside view of a right-handed golfer's right foot showing preferred positioning of inserts according to the present invention.
Figure 10:
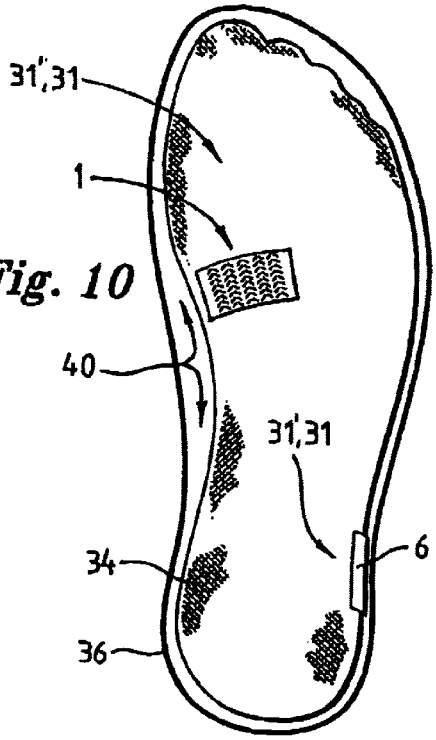
FIG. 10 shows a schematic underside plan view of a right-hand golfer's left foot showing preferred positioning of an insert according to the present invention.

FIGS. 9 and 10 show respectively a first support surface 31 in the form of right sock 32 and a second support surface 31' in the form of left sock 34, or the reverse, within a pair of shoes 36 (i.e., in underside view).

One preferred use of pad 1 is to arrange it (e.g., by attachment of free end regions 5) within right and left socks 32, 34. Referring to FIG. 9, a preferred arrangement includes incorporating as fastening pad 1 within sock 32 so that it is adjacent to and generally in front of the right heel pad of the foot of a golfer when the sock is pulled on and so that it is immediately adjacent to and within a rear region of the right foot arch. This is a so called "positive indication" position, indicating correct swing stance in use.

A second pad 6 is fasteningly arranged within sock 32 so that it is located at the lateral side of the right foot big toe, and extends around to the front (tip) of that toe of the golfer when the sock is pulled on.

Referring to FIG. 10, a pad 1 is fasteningly arranged within left sock 34 so that it is adjacent to the arch of the left foot and is behind the right ball of the golfer when the sock is pulled on. A second pad 6 is positioned to be adjacent to the lateral (outward) side of the left heal when the golfer pulls on sock 34.

The pads are positioned so as not to intrude or to be uncomfortably sensed by the golfer when the golfer is simply walking (e.g., when the golfer is not attempting the predetermined stance during a golf swing) i.e., so that the pads are generally passive when not required for instruction during the swing. Thus the pads do not desensitize the area adjacent to which they are located.

It is well documented, (see for example the book by Irwin, Hale: "Play Better Golf", 1980 Octopus Books Limited), that during the back swing of the golf club, a golfer typically anchors his weight (up to 60%) above the right foot and the whole of the golfer's upper body movement tends to pivot around the right leg. In particular the golfer's body weight tends to be concentrated in a line running down the inside of the right leg of the golfer. The anchoring of the golfer's right foot enables energy generated by the back swing and the rotation of the golfer's hips and shoulders to be stored within the golfer's body. This storage is further facilitated by a slight and characteristic flexing of the right knee.

The location of the pad 1 at the right foot is such that, during the desirable weight anchoring of the right foot as immediately described above, pressure points are realized in the golfer's right and left feet. The presence of the loops 3 are then sensed tactilely by the golfer in the right arch adjacent to the heel end in the left arch adjacent to the ball. This provides a positive and immediate affirmation to the golfer that he is maintaining his right foot in a recommended position during the back swing.

It is generally surmised (Irwin, Hale above) that, at the top of the back swing, 60% of the golfer's weight is on the inside of the right foot and 40% is on the inside of the left foot. Thus, it is desirable that the back swing pivots around firm and flexed right and left legs, with the major portion of the golfer's weight not moving further back than being centred over the inside of the right foot. The right arch pad 1 and left pad 1 have been located to provide an indication to the golfer that such deviations are not occurring and that the weight is properly distributed.

As can be seen, the pads "diagonally" oppose each other across the space between right and left feet, and this corresponds with the development of pressure points resulting from the upper body weight shift (i.e., the turning of the hips and shoulders during the back swing).

Thus the pads 1 prove to the golfer that it is the hips and shoulders that have turned. This then provides for an accurate controlled swing and maintains the position of the club head through the swing (i.e., to be the same at address, at the top of the swing and again at golf ball contact).

Immediately after the golf club has reached the top of the swing, the golfer begins the characteristic down swing portion of the golf swing. In a correct swing, the golfer's weight and swing momentum should then be transferred from the right leg to the left leg and thus from the right to the left foot. If the weight is not transferred properly from the right to the left foot, (in a large part determined by proper movement in the feet), then a large proportion of the latent power generated by the swing will be lost, and there will be a decrease in club speed at impact. The pads 1 continue to indicate proper weight distribution during the downswing and up until ball contact.

At and after the point of impact of the golf club with the golf ball, the golfer's weight progressively shifts to the outside of the left foot, which eventually laterally rolls over towards the completion of the swing. The golfer's hips and shoulders now start to rotate towards the target and the golf club head follows. The golf swing is now in the "follow through" mode and if swing power is to be maintained the golfer's weight needs to be properly transferred. The lateral outside portion of the left foot should continue rolling over laterally, and the golfer's right foot should lift and turn so that, ultimately, the toes of the golfer's right foot are pointing at approximately 90° towards the ground.

Immediate and positive affirmation that these two latter functions of the left and right foot have been correctly performed are provided respectively by the pad 6 positioned in front of the golfer's right big toe, and the pad 6 positioned laterally and at the outside of the golfer's left foot. Thus, as the right big toe progressively points downwardly towards the ground, the golfer senses in his right big toe the presence of right foot pad 6. Similarly, as the golfer's left foot starts to roll over during the down swing/follow through, the golfer also senses the presence of the left foot pad 6. This also proves to the golfer that body weight has been transferred from right to left.

If the golfer ensures that the shift of weight between the right and left feet is properly enacted, then it is difficult for any other part of the body to get out of position and out of rhythm. Equally if the balance of the feet is correct, the swing becomes more balanced, (Irwin, Hale above). Thus the inserts can be used to enhance golf player performance.

In addition or as an alternative to the composite pad arrangements shown in FIGS. 9 and 10, which provide a positive affirmation to the golfer that his feet have assumed the predetermined stance during the golf swing, further pads may be positioned which provide a tactile stimulus to the golfer indicating that he has deviated from the predetermined stance.

For example, a common deviation from the predetermined stance occurs during the back swing when the golfer tends to roll laterally over onto the outside of his right foot. Thus, a different pad can be provided adjacent to the region 38 (e.g., such as pad 1, 6, 10 or 22).

A further common deviation from the predetermined stance occurs during the follow through when the golfer inadvertently maintains weight along the inside of his left leg, and does not allow the characteristic lateral rolling over of the left foot. This tendency can be sensed by positioning a pad (e.g., pad 1, 6, 10 or 22) in region 40 in the arch of the left foot.

However, it is most preferred that either one set of positively positioned pads or one set of negatively positioned pads are employed so as to not confuse the golfer with a plethora of incoming tactile sensory signals.

Figure 11:
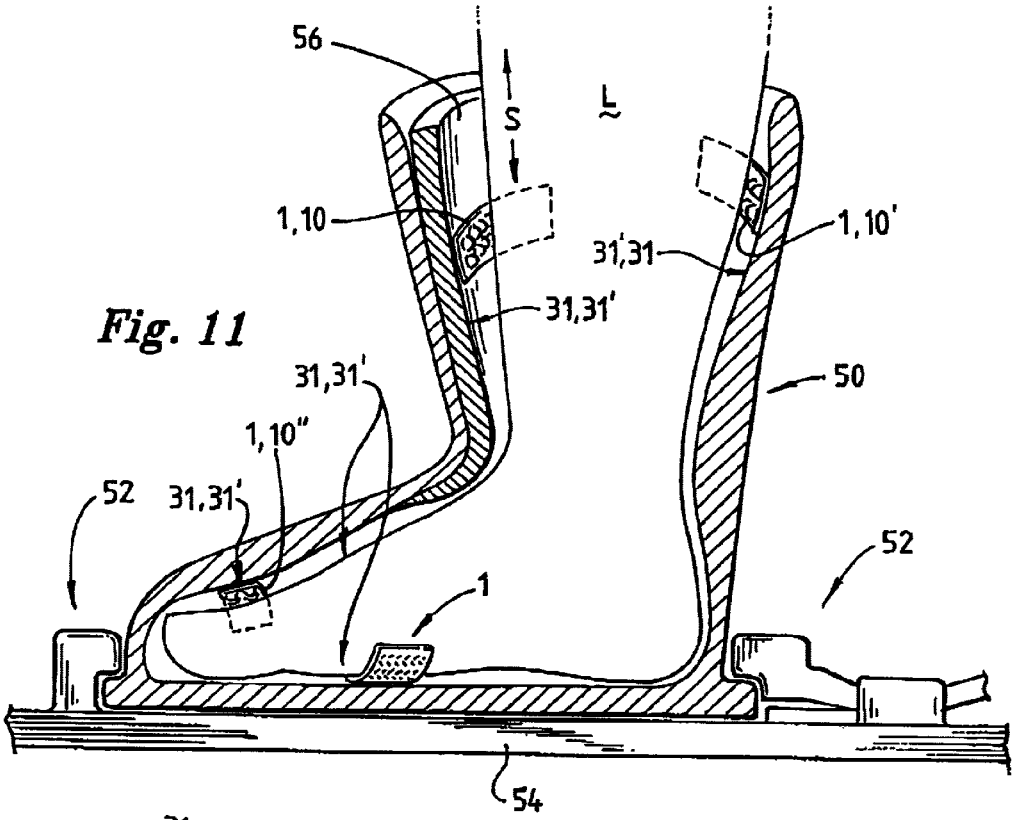
FIG. 11 shows a schematic cross-sectional side view through a skier's boot showing preferred positioning of inserts according to the present invention when used in the sport of snow-skiing.

Referring to FIG. 11, a schematic cross-section through a ski-boot 50 is shown. The ski-boot is shown fixed to bindings 52 of a ski 54.

The ski-boot includes, as is usual, a support surface 31 and /or 31' in the form of tongue 56 against which the shin S of a user's leg L can engage.

A pad 1, 6, 10 or 22 (as described above) can be arranged on the tongue in a position that would be engaged by the shin when the user's leg is leaning forward. Alternatively, this pad may be positioned on a support surface 31 and/or 31' in the form of a user's sock adjacent to the shin.

It is also preferred that a pad 1 is arranged in the arch of each user's foot, immediately behind the ball of each foot, (i.e., in a similar position for the left foot of a golfer). This pad is engaged by the user's arch when leaning forward, and typically an abrasive, (hook or loop fastening-type pad is employed). This pad, and the pad on the tongue, provide positive indication to the user that the correct stance (i.e., leaning forward in the boot) is being maintained.

An (optionally) different pad 1, 10' can be arranged on a support surface 31 and/or 31' at a back portion of the boot to be engaged by the calf of a user's leg when the user is leaning back (i.e., to provide a negative indication to the user).

Furthermore, a pad 1, 10" can be positioned on a support surface 31 and above/or 31' a user's toes (or front-foot region), again for engagement by the toes as the user leans back (i.e., where the feet move upwardly in and relative to the boot). The pads 10' and 10" provide an indication to the user that they are not positioning their weight properly in the boot and over the skis.

Referring to FIG. 12, a different type of insert is shown in the form of a hook and loop fastening system 60. The system includes a hook base 62 attached to a support surface 31 and a loop cover 64 (shown partially peeled back to reveal base 62). The a system is generally known as a Velcro® system.

The system 60 is shown positioned under the arch of the big toe T but can be similarly used in other positions (as described) above. The system can be attached to support surface 31 in the form of socks or fitted a support surface 31 in the form of shoes etc. The system proves to a skier that they are leaning forward in their boots (the desirable configuration) i.e., the users toes are pressing down.

In one mode of use, the system is used only with the hook base 62 (i.e., with the loop cover 64 being removed altogether). Thus, the plurality of small hooks in the base provide the necessary tactile indication to the user (e.g., at the toe arch). However, if this is too agitating or uncomfortable for the user, then the loop cover 64 can be reattached to base 62 to provide a softer pad (i.e., akin to pad 22). Alternatively, the system can be used solely with the cover 64, taking advantage of the softer loop portions of the system.

Thus, the hook and loop fastening system 60 provides flexibility of use. Also, the base 62 (or cover 64) can be readily attached to socks, shoes etc (being flexible and therefore easily attached through sewing, adhesive etc).

Typically the pads 10, 10', 10", 60 are arranged on a support surface 31 in the form of the socks of a user, rather than fitting to the boot itself, or alternatively they can be provided in an insert of some type which is arranged on a support surface 31 within the form of a boot prior to the user fitting the boot thereto.

Generally, the pads 1, 6, 10, 22 can be seamlessly incorporated onto support surfaces 31 in the form of socks, shoes, boots etc (with Velcro® pads being alignable with and/or extendible through the stitching thereof). The inserts can be formed directly at the time of weaving, or may be separately attached. The pads can be located both inside and/or outside the sock. Differing degrees of tactile indication (e.g., degrees of sharpness) can be employed, and inside/outside location may be predetermined by a user's individual foot construction (e.g., users with a high instep may select socks with an internal arch pad, whereas users with a low instep (flat footed people) may select socks with an external arch pad).

The employment of inserts such as the pads described above also enables existing sporting apparatus to be simply modified so that it can be used both as an educational or immediate instructive tool (e.g., during golf and ski coaching). The inserts can thus offer immediate feedback to all users, from beginners to professionals, throughout the entire golf game or ski session etc.

Also, various combinations of tactile indications can be employed, such as sharp, abrasive, soft or even hot and cold (e.g., pads having encapsulated fluid for heating/cooling by the body or by a separate source).

Because many users do not have sufficient time to practice, the preferred embodiments described above at least provide an immediate feedback to the user which may shorten and in some cases obviate the need for extensive or regular practice sessions. The various embodiments described above also address educationally and intuitively fundamental aspects of the sport under consideration, including the mechanism and sensing of weight transfer during a swing, during travel etc.

Inserts, such as the pads described above, can be affixed to support surfaces 31 in the form of socks or to one or both shoe or boots, or other articles of clothing as dependent upon the sport or activity. In some situations, the inserts may be directly attached to support surface 31 in the form of the user's body part (particularly in a coaching or training environment).

While the invention has been described with reference to a number of preferred embodiments, it should be appreciated that the invention can be embodied in many other forms.

What is claimed is:

1. An indication device for guiding a predetermined golf swing action, by interacting with at least one foot of the golfer to provide to the at least one foot tactile indication of a selected body position assumed by the golfer during a golf swing action by indicating a selected weight distribution on the at least one foot of the golfer, and providing no effective tactile indication to the golfer when a golfer does not assume the selected body position, the indication device comprising:

a support surface which is arranged to engage one foot and is shaped to locate the support surface in a predetermined position against at least part of the one foot, a resilient back swing pad for providing a tactile indication to a foot of the golfer when the golfer assumes a back swing position, the back swing pad being secured to the support surface and so disposed in a position on that surface so that when the support surface is disposed in the predetermined position against the one foot, the resilient back swing pad locates under the inner side of the arch of the one foot and adjacent the heel of the foot, wherein in use, the one foot is the back swing foot of the golfer and the location, thickness and surface of the resilient back swing pad are selected to provide an adequate tactile sensation to indicate when the golfer is in the back swing position and, to provide a significantly reduced tactile sensation when the golfer is in a body position other than the back swing position, such that the one foot does not become desensitized to the pad during activities other than the golf swing action.

2. The indication device of claim 1, further comprising:

a second support surface which is arranged to engage the other foot of the golfer and is shaped to locate the second support surface in a predetermined position against at least part of the other foot, a resilient follow through pad for providing a tactile indication to a foot of the golfer when the golfer assumes the follow through position, the follow through pad being secured to the support surface and so disposed in a position on that surface so that when the support surface is disposed in the predetermined position against the other foot, the resilient follow through pad locates laterally to and at the outside of the other foot and adjacent to the heel thereof, wherein in use, the other foot is the follow through foot of the golfer and the location, thickness and surface of the resilient follow through pad are selected to provide an adequate tactile sensation to indicate when the golfer is in the follow through position and to provide a significantly reduced tactile sensation when the golfer is in a body position other than the follow through position, such that the golfer's feet do not become desensitized to the pads during activities other than the golf swing action.

3. The indication device of claim 1, further comprising:

a second support surface which is arranged to engage the other foot of the golfer and is shaped to locate the second support surface in a predetermined position against at least part of the other foot, a second resilient back swing pad for providing a tactile indication to a foot of the golfer when the golfer assumes the follow through position, the second resilient back swing pad being secured to the support surface and so disposed in a position on that surface so that when the support surface is disposed in the predetermined position against the other foot, the second resilient back swing pad locates under the arch of the other foot, in the region along the inside of the arch and behind the big toe and adjacent the arch side of the ball of the other foot wherein the location, thickness and surface of the second resilient back swing pad are selected to provide an adequate tactile sensation to indicate when the golfer is in the back swing position and, to provide a significantly reduced tactile sensation when the golfer is in a body position other than the selected body position, such that the golfer's feet do not become desensitized to the pad during activities other than the golf swing action.

4. The indication device of claim 1, wherein the or each support surface is selected from the group comprising:

a sock, an insole or an inner surface of a shoe.

5. An indication device for guiding a predetermined golf swing action, by interacting with at least one foot of the golfer to provide to the at least one foot tactile indication of a selected body position assumed by the golfer during a golf swing action by indicating a selected weight distribution on the at least one foot of the golfer, and providing no effective tactile indication to the golfer when a golfer does not assume the selected body position, the indication device comprising:

a support surface which is arranged to engage one foot and is shaped to locate the support surface in a predetermined position against at least part of the one foot, a resilient follow through pad for providing a tactile indication to a foot of the golfer when the golfer has assumed a follow through position, the follow through pad being secured to the support surface and so disposed in a position on that surface so that when the support surface is disposed in the predetermined position against the one foot, the resilient follow through pad locates at the lateral side of and extends in front of the tip of the big toe of the one foot, wherein in use, the one foot is the back swing foot of the golfer and the location, thickness, and surface of the resilient follow through pad are selected to provide an adequate tactile sensation to indicate when the golfer is in the follow through position and to provide a significantly reduced tactile sensation when the golfer is in a body position other than the follow through position, such that the one foot does not become desensitized to the pad during activities other than the golf swing action.

6. The indication device of claim 5, further comprising:

a second support surface which is arranged to engage the other foot of the golfer and is shaped to locate the second support surface in a predetermined position against at least part of the other foot, a second resilient follow through pad for providing a tactile indication to a foot of the golfer when the golfer assumes the follow through position, the second follow through pad being secured to the support surface and so disposed in a position on that surface so that when the support surface is disposed in the predetermined position against the other foot, the second resilient follow through pad locates laterally to and at the outside of the other foot and adjacent to the heel thereof, wherein in use, the other foot is the follow through foot of the golfer and the location, thickness and surface of the second resilient follow through pad are selected to provide an adequate tactile sensation to indicate when the golfer is in the follow through position and to provide a significantly reduced tactile sensation when the golfer is in a body position other than the follow through position, such that the golfer's feet do not become desensitized to the pads during activities other than the golf swing action.

7. The indication device of claim 5, further comprising:

a second support surface which is arranged to engage the other foot of the golfer and is shaped to locate the second support surface in a predetermined position against at least part of the other foot, a resilient back swing pad for providing a tactile indication to a foot of the golfer when the golfer assumes the back swing position,the second resilient back swing pad being secured to the support surface and so disposed in a position on that surface so that when the support surface is disposed in the predetermined position against the other foot, the resilient back swing pad locates under the arch of the other foot, in the region along the inside of the arch and behind the big toe and adjacent the arch side of the ball of the other foot and wherein the location, thickness and surface of the resilient back swing pad are selected to provide an adequate tactile sensation to indicate when the golfer is in the back swing position and to provide a significantly reduced tactile sensation when the golfer is in a body position other than the selected body position such that the golfer's feet do not become desensitized to the pads during activities other than the golf swing action.

8. The indication device of claim 5, wherein the or each support surface is selected from the group comprising:

a sock, an insole or an inner surface of a shoe.

9. An indication device for guiding a predetermined golf swing action by interacting with at least one foot of the golfer to provide to the at least one foot tactile indication of a selected body position assumed by the golfer during a golf swing action by indicating a selected weight distribution on the at least one foot of the golfer, and providing no effective tactile indication to the golfer when a golfer does not assume the selected body position, the indication device comprising:

a support surface which is arranged to engage one foot and is shaped to locate the support surface in a predetermined position against at least part of the one foot, a resilient back swing pad for providing a tactile indication to a foot of the golfer when the golfer assumes a back swing position, the back swing pad being secured to the support surface and so disposed in a position on that surface so that when the support surface is disposed in the predetermined position against the one foot, the resilient back swing pad locates under the inner side of the arch of the one foot and adjacent the heel of the one foot, and a resilient follow through pad for providing a tactile indication to a foot of the golfer when the golfer has assumed a follow through position, the follow through pad being secured to the support surface and so disposed in a position on that surface so that when the support surface is disposed in the predetermined position against the one foot, the resilient follow through pad locates at the lateral side of and extends in front of the tip of the big toe of the one foot, wherein, in use, the one foot is the back swing foot of the golfer and the location, thickness and surface of each of the resilient back swing and follow through pads are each selected to provide an adequate tactile sensation to indicate when the golfer is in the follow through position, and to provide a significantly reduced tactile sensation when the golfer is in a body position other than the follow through position, such that the one foot does not become desensitized to the pad during activities other than the golf swing action.

10. The indication device of claim 9, further comprising:

a second support surface which is arranged to engage the other foot of the golfer and is shaped to locate the second support surface in a predetermined position against at least part of the other foot, a second resilient follow through pad for providing a tactile indication to a foot of the golfer when the golfer assumes the follow through position, the second follow through pad being secured to the support surface and so disposed in a position on that surface so that when the support surface is disposed in the predetermined position against the other foot, the second resilient follow through pad locates laterally to and at the outside of the other foot and adjacent to the heel thereof, wherein in use, the other foot is the follow through foot of the golfer and the location, thickness and surface of the second resilient follow through pad are selected to provide an adequate tactile sensation to indicate when the golfer is in the follow through position and to provide a significantly reduced tactile sensation when the golfer is in a body position other than the follow through position, such that the golfer's feet do not become desensitized to the pads during activities other than the golf swing action.

11. The indication device of claim 9, further comprising:

a second support surface which is arranged to engage the other foot of the golfer and is shaped to locate the second support surface in a predetermined position against at least part of the other foot, a second resilient back swing pad for providing a tactile indication to a foot of the golfer when the golfer assumes the back swing position, the second resilient back swing pad being secured to the support surface and so disposed in a position on that surface so that when the support surface is disposed in the predetermined position against the other foot, the second resilient back swing pad locates under the arch of the other foot, in the region along the inside of the arch and behind the big toe and adjacent the arch side of the ball of the other foot and wherein the location, thickness and surface of the second resilient back swing pad selected to provide an adequate tactile sensation to indicate when the golfer is in the back swing position and, to provide a significantly reduced tactile sensation when the golfer is in a body position other than the selected body position, such that the golfer's feet do not become desensitized to the pads during activities other than the golf swing action.

12. The indication device of claim 11, further comprising:

a second resilient follow through pad for providing a tactile indication to a foot of the golfer when the golfer assumes the follow through position, the second resilient follow through pad being secured to the second support surface and so disposed in a position on that surface so that when the second support surface is disposed in the predetermined position against the other foot, the second resilient follow through pad locates laterally to and at the outside of the other foot and adjacent to the heel thereof, and wherein the location, thickness and surface of the second resilient back swing pad and of the second follow through pad are selected to provide an adequate tactile sensation to indicate when the golfer is in the follow through position, to provide a significantly reduced tactile sensation when the golfer is in a body position other than a selected body position, such that the golfer's feet do not become desensitized to the pad during activities other than the golf swing action.

13. The indication device of claim 9, wherein the or each support surface is selected from the group comprising:

a sock, an insole or an inner surface of a shoe.

14. An indication device for guiding a predetermined golf swing action by interacting with at least one foot of the golfer to provide to the at least one foot tactile indication of a selected body position assumed by the golfer during a golf swing action by indicating a selected weight distribution on the at least one foot of the golfer, and providing no effective tactile indication to the golfer when the golfer does not assume the selected body position, the indication device comprising:

a support surface which is arranged to engage one foot and is shaped to locate the support surface in a predetermined position against at least part of the one foot, a resilient pad for providing a tactile indication to a foot of the golfer when the golfer assumes the selected body position, the pad being secured to the support surface and so disposed in a position on that surface so that when the support surface is disposed in the predetermined position against the one foot, the resilient pad locates under the arch behind the big toe, and wherein the location, thickness and surface of the resilient pad are selected to provide an adequate tactile sensation to indicate when the golfer is in the selected body position and, to provide a significantly reduced tactile sensation when the golfer is in a body position other than the selected body position, such that the golfer's foot does not become desensitized to the pad during activities other than the golf swing action.

15. An indication device for guiding a predetermined stance in sport, by interacting with at least one foot of a user to provide to the at least one foot tactile indication of a selected body position assumed by the user during use in the sport by indicating a selected weight distribution on the at least one foot of the user, and providing no effective tactile indication to the user when the user does not assume the selected body position, the indication device comprising:

a support surface which is arranged to engage one foot and is shaped to locate the support surface in a predetermined position against at least part of the one foot.

a resilient pad for providing a tactile indication to a foot of the user when the user assumes the selected body position, the pad being secured to the support surface and so disposed in a position on that surface so that when the support surface is disposed in the predetermined position against the one foot, wherein the resilient pad is located under the arch behind the big toe, wherein the location, thickness and surface of the resilient pad are selected to provide an adequate tactile sensation to indicate when the user is in the selected body position and, to provide a significantly reduced tactile sensation when the user is in a body position other than the selected body position, such that the users foot does not become desensitized to the pad during activities other than the predetermined stance.

16. An indication device for guiding a predetermined stance in skiing, by interacting with at least one foot of the skier to provide to the at least one foot tactile indication of a selected body position assumed by the skier during a skiing motion by indicating a selected weight distribution on the at least one foot of the skier, and providing no effective tactile indication to the skier when the skier does not assume the selected body position, the indication device comprising:

a support surface which is arranged to engage one foot and is shaped to locate the support surface in a predetermined position against at least part of the one foot, a resilient pad for providing a tactile indication to a foot of the skier when the skier assumes the selected position, the pad being secured to the support surface and so disposed in a position on that surface so that when the support surface is disposed in the predetermined position against the one foot, the resilient pad locates under the arch behind the big toe, wherein the location, thickness and surface of the resilient pad are selected to provide an adequate tactile sensation to indicate when the skier is in the selected body position and, to provide a significantly reduced tactile sensation when the skier is in a body position other than the selected body position, such that the skier's foot does not become desensitized to the pad during activities other than the skiing motion.

* * * * *